US008188355B2

(12) United States Patent
Tochilin

(10) Patent No.: US 8,188,355 B2
(45) Date of Patent: May 29, 2012

(54) ADJUSTABLE DEPTH SNARE DRUM

(76) Inventor: Brian Eugene Tochilin, Orange, CA (US)

( * ) Notice: Subject to any disclaimer, the term of this patent is extended or adjusted under 35 U.S.C. 154(b) by 0 days.

(21) Appl. No.: 12/828,843

(22) Filed: Jul. 1, 2010

(65) Prior Publication Data

US 2012/0000341 A1 Jan. 5, 2012

(51) Int. Cl.
*G10D 13/02* (2006.01)

(52) U.S. Cl. ..... 84/415

(58) Field of Classification Search ..... 84/411 R, 84/415–417

See application file for complete search history.

(56) References Cited

U.S. PATENT DOCUMENTS 7,781,659 B2 * 8/2010 Liao ..... 84/412

* cited by examiner

*Primary Examiner* — Kimberly Lockett

(74) *Attorney, Agent, or Firm* — Oakwood Law Group, LLP; Yuchien Wei

(57) ABSTRACT

A snare drum having four cylindrical members which nest within and are permanently attached to each other from the top shell of the drum. The top ends of the four cylindrical members are located adjacent to each other and the bottom ends of the third and fourth cylindrical members are located below the bottom ends of the first and second cylindrical members. A fifth cylindrical member slides axially along the lower end of the third cylindrical member. The top ends of the four cylindrical members are covered by a first drum head and the bottom ends of the third and fourth cylindrical members are covered by a second drum head. The four cylindrical members are the top shell for the drum and the fifth cylindrical member is the bottom shell for the drum. The distance between the first and second drum heads change as the fifth cylindrical member is manually moved axially along the third cylindrical member.

17 Claims, 4 Drawing Sheets

ADJUSTABLE DEPTH SNARE DRUM

BACKGROUND OF THE INVENTION

1. Field of the Invention

The present invention relates generally to a drum structure, and more particularly to a snare drum having a unitary top drum shell composed of four separate cylindrical members permanently attached to each other which is slidably coupled to a bottom snare drum shell to impart a desired sound by changing the depth of the snare drum.

2. Description of Related Art

Drums which are substantially sealed or open with respect to the surrounding atmosphere, but which may be adjusted to alter the contained volume within the closed drum is known in the prior art. More specifically, by way of example, U.S. Pat. No. 6,441,287 to Crouch, et al. discloses a snare drum assembly which enables the snare drum element to be positioned internally of a drum. The snare mechanism acts against the top drum head of a drum which allows lower drum head and related structure to be eliminated.

U.S. Pat. No. 6,462,262 to Hagiwara discloses a drum main body having first, second and third drum body elements of cylindrical shape where the third drum body element is located between the first and second drum body elements and the first, second and third drum body elements can have different lengths.

U.S. Pat. No. 5,377,576 to Good, et al. discloses a drum shell having cylindrical sections located in axially end-to-end positions; where a first section is wood and the second and third sections are of metal.

U.S. Pat. No. 4,300,437 to Hinger, et al. discloses a drum having two, axially-separable cylindrical sections. When the open ends of the two sections are axially spaced-apart to provide an annular gap between them, the space within the sections communicates with the ambient air, through the gap to increase the volume of the drum. Means are provided for varying the size of the gap, or for closing it altogether; whereby the pitch and tonal characteristics of the drum can be varied.

U.S. Pat. No. 4,060,019 to Cordes discloses a drum having two cylindrical shells which are telescopically arranged for axial adjustment with respect to each other. One of the shells is constructed of metal and a separate set of casings for each drum head are provided on each shell. A number of spaced apart insulating strips are located between the shells which can be adjusted in a stepwise manner relative to each other.

SUMMARY OF THE INVENTION

In an exemplary embodiment of the present invention, there is disclosed a snare drum comprising:

a first cylindrical member having a top end and a bottom end;

a second cylindrical member located within and attached to the first cylindrical member and having top and bottom ends located adjacent top and bottom ends of the first cylindrical member;

a third cylindrical member having a top end located within and attached to the second cylindrical member and a bottom end located below the bottom ends of the first and second cylindrical members;

a fourth cylindrical member having a top end located within and attached to the third cylindrical member and a bottom end located adjacent the bottom end of the third cylindrical member;

a fifth cylindrical member located around and adjustably movable axially along the lower end of the third cylindrical member;

said top ends of the first, second, third and fourth cylindrical members covered by a first drum head and the bottom ends of the third and fourth cylindrical members covered by a second drum head; and wherein the first, second, third and fourth cylindrical members are the top shell for a snare drum and the fifth cylindrical member is the bottom shell for the snare drum; and wherein the distance between the first and second drum heads change at will as the fifth cylindrical member moves axially along the lower end of the third cylindrical member.

In an embodiment of the invention the various parts of the snare drum can be made of various materials such as, for example, wood, plastic or metal to obtain slightly different sounds. For example, the various parts of the snare drum can be made of any type of wood which can include but is not limited to maple, birch, mahogany, etc., or it can be made of any type of plastic which can include but is not limited to acrylic, carbon fiber, graphite, fiberglass, etc., or it can be made of any type of metal which can include but is not limited to brass, steel, aluminum, bronze, titanium, nickel, etc., or other material deemed appropriate.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Snare drums may be made from various wood, metal, or plastic materials. A typical diameter for snare drums is 14 inches. Marching snare drums are deeper in size than snare drums normally which are used for orchestral or drum kit purposes. Orchestra and drum set snare drum shells are about 6 inches deep. Piccolo snare drums are even shallower at about 3 inches deep. Soprano, popcorn, and firecracker snare drums have diameters as small as 8 inches and are often used for high pitched special effects.

Most snare drums are constructed in plies that are heat and compression molded into a cylinder. Steam-bent shells consist of one ply of wood that is gradually rounded into a cylinder and glued at one seam. Reinforcement hoops are generally needed on the inside surface of the drum to keep it perfectly round. Segment shells are made of multiple stacks of segmented wood rings. The segments are glued together and rounded on a lathe. Similarly, stave shells are constructed of vertically glued pieces of wood into a cylinder much like a barrel and is also rounded with a lathe. Solid shells are constructed of a single solid piece of hollowed wood and have small snares underneath.

Traditional snare drums have a depth and width that is fixed and cannot be changed. In addition, the traditional snare drum which is made of laminated plies of wood normally has a fixed thickness which is normally limited to ten plies, more or less.

The snare drum here disclosed now avoids the limitations of depth associated with snare drums. An example of why the new feature of having a snare drum that has an adjustable depth satisfies a long felt need is as follows. A snare drum musician is performing at a show or at a recording studio and his six inch deep by fourteen inch diameter snare drum works for most songs and/or music. However, for a few songs or music a different sound is needed. This is a common occurrence which happens very frequently. When this need for a different sound occurs the musician has two options. He can stay with one drum or he can bring two, three or more snare drums to the show or studio. Now, with the adjustable depth snare drum here disclosed the need for a drummer to have multiple drums to obtain different sounds is eliminated. The depth of the snare drum disclosed can be adjusted from a depth of five inches to a depth of seven and one half inches, and everything in between to produce the new sound that is needed. The depth of the snare drum can be changed very quickly by simply turning three standard tension rods with a standard drum key that every drummer has. The top drum shell 10 is composed of four separate and distinct members which are nested within each other and joined together with an adhesive such as an epoxy glue to form a unitary member that has a total of twenty four plies. Each cylindrical member of the top shell may be made of, for example, Maple or any other type of wood or material.

Figure 6:
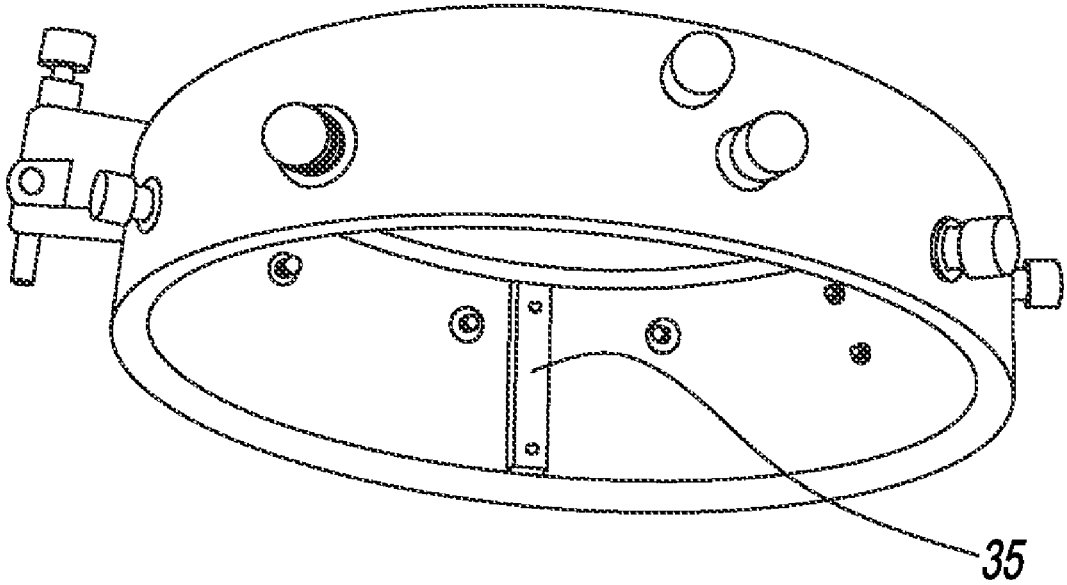
FIG. 6 is a perspective side view of the bottom shell showing the aluminum bar.

Cylindrical member 12 has an outside diameter of fourteen inches, a depth of two inches and is made with six plies of Maple wood. Cylindrical member 14 has a depth of two inches and is made with five plies of Maple wood. The outside diameter of cylindrical member 14 is cut to slide into cylindrical member 12 with a snug fit. Cylindrical member 16 has a depth of five inches and is made with eight plies of Maple wood. The outside diameter of cylindrical member 16 is cut to slide into cylindrical member 14 with a snug fit. Cylindrical member 16 includes a slot 18 which has a width of about seven sixteenths of an inch and extends for a distance of about three inches from the bottom edge. Slot 18 cooperates with an aluminum bar 35 (see FIG. 6) that is located on the bottom snare drum shell to align the top drum shell with the bottom drum shell. Cylindrical member 20 has a depth of five inches and is made with five plies of Maple wood. The outside diameter of cylindrical member 20 is cut to slide into cylindrical member 16 with a snug fit.

To assemble the top drum shell 10, cylindrical member 14 is fully inserted into cylindrical member 12 and is permanently attached to cylindrical member 12 with an adhesive such as an epoxy glue. At this time the top and bottom edges of the two cylindrical members are in alignment, the two cylindrical members are permanently attached to each other and the part has a thickness of eleven plies. Next, cylindrical member 16 is inserted into cylindrical member 14 and is permanently attached to cylindrical member 12 with an adhesive such as an epoxy glue. At this time the top edge of cylindrical member 16 is flush with the top edges of cylindrical members 12, 14, and the three cylindrical members are permanently attached to each other. The part formed by the three cylindrical members has a thickness of nineteen plies at the top two inches and a thickness of eight plies at the bottom three inches. Now cylindrical member 20 is inserted into cylindrical member 16 and is permanently attached to cylindrical member 16 with an adhesive such as an epoxy glue. At this time the top edge of cylindrical member 20 is flush with the top edges of cylindrical members 12, 14 and 16 and the bottom edge of cylindrical member 20 is flush with the bottom edge of cylindrical member 16. The four cylindrical members are permanently attached to each other and form a unitary part which will be the top shell 10 for the snare drum. The top shell 10 for the snare drum formed by the four cylindrical members has a thickness of twenty four plies at the top two inches and a thickness of thirteen plies at the bottom three inches.

Figure 1:
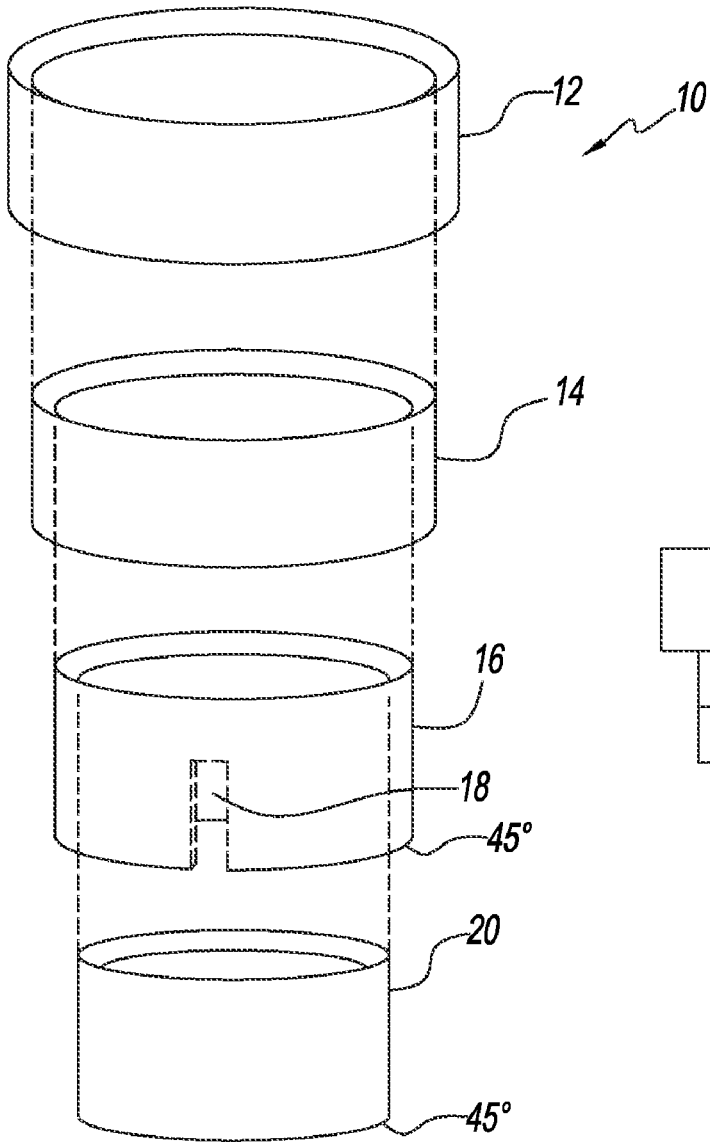
FIG. 1 is an exploded view of a 14 inch, four pieces, 24 ply top snare drum top shell made in accordance with the principles of the invention without drum hardware or drilled openings for drum hardware.
Figure 2:
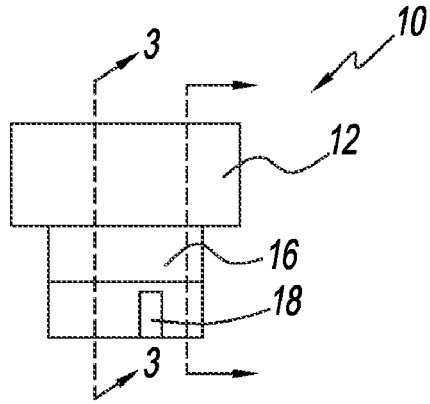
FIG. 2 is a side view of the four pieces of the 14 inch 24 ply snare drum top shell assembled and permanently joined together with an adhesive to form a unitary member in accordance with the principles of the invention without drum hardware or drilled openings for drum hardware.

Referring to FIG. 2, there is shown a side view of the four pieces of the 14 inch 24 ply drum top shell assembled and joined together with an adhesive to form a unitary member in accordance with the principles of the invention. The top and bottom edges of shell 10 are cut to have the standard forty five degree bearing cuts.

Figure 3:
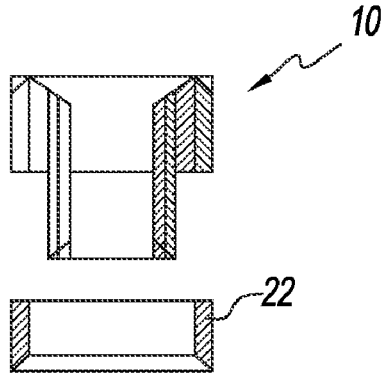
FIG. 3 is a sectional view along the line 3-3 of FIG. 2 in combination with a fourteen inch diameter ten ply Maple snare drum bottom shell.

Referring to FIG. 3, there is shown a sectional view along the line 3-3 of FIG. 2 where the top end of the top shell has a double chamfer cut and the bottom edge has a single chamfer cut. Located below the top shell 10 in FIG. 3 is a sectional view of the bottom shell 22 which can be a Keller VSS fourteen inch diameter, ten ply Maple snare drum shell with a height of three inches, where the bottom end of the bottom shell has a double chamfer cut. The bottom three inches of the top shell has a diameter that is slightly less than the inside diameter of the bottom shell 22 and forms a sliding fit with bottom shell 22. The diameter of the top two inches of the top shell is substantially equal to the outside diameter of the bottom shell which is fourteen inches, more or less. At this time the surface of the top and bottom shells are sanded smooth and finished and then the various holes are drilled in the two shells to accept the drum hardware.

Figure 4:
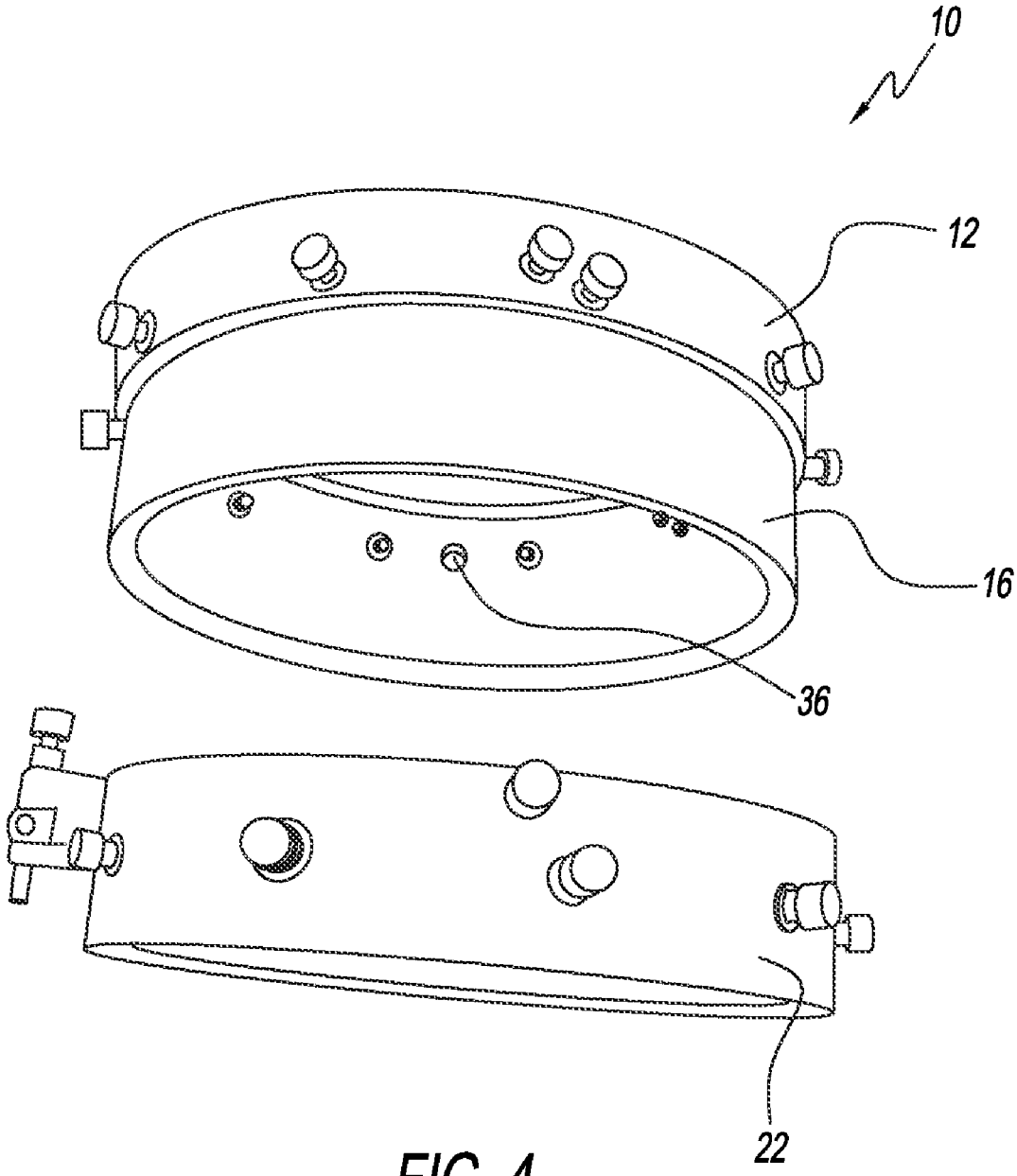
FIG. 4 is an exploded side view of the four pieces of the 24 ply snare drum top shell assembled and joined together with an adhesive to form a unitary member which is slidably coupled to a 14 inch 10 ply Keller VSS Maple Snare drum bottom shell in accordance with the principles of the invention.

Looking a FIG. 4, there is shown an exploded perspective view of the top and bottom shells with drum hardware attached. Opening 36 is a vent hole approximately three eights of an inch in diameter that passes through the 24 plies of the top shell 10.

Figure 5:
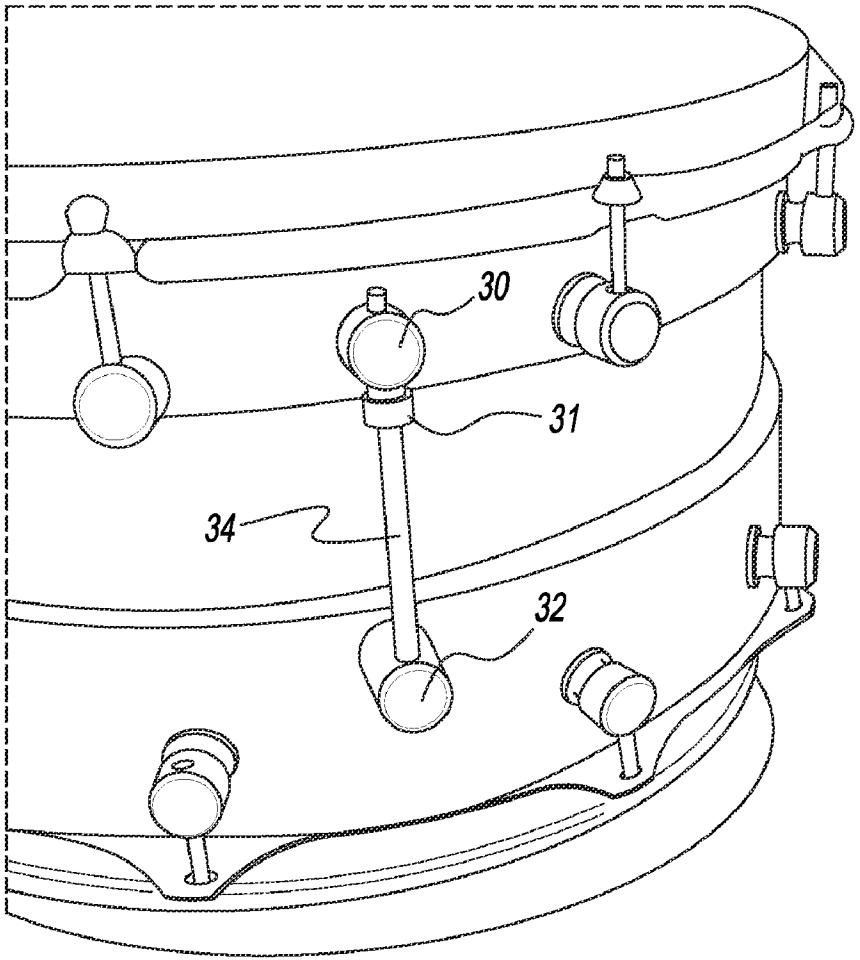
FIG. 5 is a partial view of a side of a snare drum where the 14 inch 24 ply top drum shell which consists of four pieces are assembled and joined together with an adhesive to form a unitary member which is slidably coupled to a 14 inch 10 ply Keller VSS Maple Snare drum bottom shell having three threaded tension rods which are equally spaced around the drum for adjusting the depth of the snare drum, where only one threaded tension rod is shown, in accordance with the principles of the invention.

Referring to FIG. 5, there is shown a partial perspective view of the assembled snare drum where one of the three tension rod adjusters which is used to set the snare drum to a desired depth is shown. The tension rod adjuster includes a first anchor member 30 which is attached to the top shell and a second anchor member 32 which is attached to the bottom shell. The top anchor member has a clearance opening and the bottom anchor member has a threaded opening for receiving a tension rod 34. Tension rod 34, which has at its top end a square head which fits a drum key and threads at its lower end, is passed through the clearance opening in the first anchor member 30 and is threaded into the threaded opening in anchor opening 32. The square head at the top end of the tension rod has a flange which is larger than the clearance opening and prevents the tension rod from falling through the clearance opening. A collar 31 is attached to the tension rod just below anchor 30 to prevent the tension rod from moving up through the clearance opening in the anchor member 30. Thus, as the tension rod is turned clockwise with drum key, the threaded end of the tension rod will pull the bottom anchor up to decrease the depth of the snare drum. In a similar manner, by turning the tension rod in a counter clockwise direction the threaded end of the tension rod will push the bottom anchor down it increase the depth of the snare drum.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A snare drum comprising:

a first cylindrical member having a top end and a bottom end;

a second cylindrical member located within and attached to the first cylindrical member and having top and bottom ends located adjacent top and bottom ends of the first cylindrical member;

a third cylindrical member having a top end located within and attached to the second cylindrical member and a bottom end located below the bottom ends of the first and second cylindrical members;

a fourth cylindrical member having a top end located within and attached to the third cylindrical member and a bottom end located adjacent the bottom end of the third cylindrical member; and a fifth cylindrical member located around and adjustably movable axially along the lower end of the third cylindrical member;

said top ends of the first, second, third and fourth cylindrical members covered by a first drum head and the bottom ends of the third and fourth cylindrical members covered by a second drum head, the first and second drum heads are separate by a distance which is adjustable:

wherein the first, second, third and fourth cylindrical members form a top shell for a snare drum and the fifth cylindrical member forms a bottom shell for the snare drum; and wherein the distance between the first and second drum heads changes at will as the fifth cylindrical member moves axially along the lower end of the third cylindrical member.

2. The snare drum of claim 1 wherein each of the cylindrical members is made from wood selected from the group consisting of maple, birch, and mahogany.

3. The snare drum of claim 1 wherein the cylindrical members consists of Maple.

4. The snare drum of claim 1 wherein means is provided for preventing the fifth cylindrical member from rotating relative to the third cylindrical member.

5. The snare drum of claim 1 wherein the third cylindrical member has a slot that slidably engages a protrusion on the fifth cylindrical member to prevent the fifth cylindrical member from rotating relative to the third cylindrical member.

6. The snare drum of claim 5 wherein the protrusion is aluminum.

7. The snare drum of claim 1 wherein the distance between the first and second drum heads can be manually changed.

8. The snare drum of claim 7 wherein the tension rod adjusters having anchor members coupled to the first and fifth cylindrical members control the distance between the first and second drum heads.

9. The snare drum of claim 8 wherein three tension rod adjusters each having a first anchor members coupled to the first cylindrical member and a second anchor members coupled to the fifth cylindrical member are equally spaced around the snare drum.

10. The snare drum of claim 2 wherein the first cylindrical member consists of six plies of wood and has a depth of approximately two inches.

11. The snare drum of claim 2 wherein the second cylindrical member consists of five plies of wood and has a depth of approximately two inches.

12. The snare drum of claim 2 wherein the third cylindrical member consists of eight plies of wood and has a depth of approximately five inches.

13. The snare drum of claim 2 wherein the fourth cylindrical member consists of five plies of wood and has a depth of approximately five inches.

14. The snare drum of claim 2 wherein the fifth cylindrical member consists of ten plies of wood and has a depth of approximately three inches.

15. The snare drum of claim 1 wherein each of the cylindrical members is made from plastic selected from the group consisting of acrylic, carbon fiber and graphite fiberglass.

16. The snare drum of claim 1 wherein each of the cylindrical members is made from metal selected from the group consisting of brass, steel, aluminum, bronze, titanium and nickel.

17. The snare drum of claim 1 wherein each of the cylindrical members is made from other materials deemed appropriate.

* * * * *